US006078855A

United States Patent [19]

Kinugawa et al.

[11] Patent Number: 6,078,855

[45] Date of Patent: Jun. 20, 2000

[54] BATTERY-DRIVEN HYDRAULIC EXCAVATOR

[75] Inventors: Hideki Kinugawa; Masayuki Komiyama, both of Hiroshima, Japan

[73] Assignee: Kabushiki Kaisha Kobe Seiko Sho, Kobe, Japan

[21] Appl. No.: 08/877,554

[22] Filed: Jun. 17, 1997

[30] Foreign Application Priority Data

| | | | |
|---|---|---|---|
| Jun. 19, 1996 | [JP] | Japan | 8-158706 |
| Jun. 20, 1996 | [JP] | Japan | 8-160122 |
| Oct. 3, 1996 | [JP] | Japan | 8-263213 |
| Apr. 15, 1997 | [JP] | Japan | 9-097547 |
| Apr. 16, 1997 | [JP] | Japan | 9-099221 |

[51] Int. Cl.[7] ..... E02F 9/08

[52] U.S. Cl. ..... 701/50; 60/431

[58] Field of Search ..... 701/50; 37/348, 37/382; 60/400, 420, 431, 493

[56] References Cited

U.S. PATENT DOCUMENTS

| | | | |
|---|---|---|---|
| 4,102,461 | 7/1978 | Soyland | 214/132 |
| 4,552,503 | 11/1985 | Mouri et al. | 414/687 |
| 4,616,872 | 10/1986 | Akira et al. | 296/190 |
| 4,723,107 | 2/1988 | Shmid | 320/61 |
| 5,046,312 | 9/1991 | Tsuda et al. | 60/493 |
| 5,329,441 | 7/1994 | Aoki et al. | 701/50 |
| 5,348,115 | 9/1994 | Devier et al. | 180/308 |
| 5,361,211 | 11/1994 | Lee et al. | 701/50 |
| 5,398,506 | 3/1995 | Martin | 60/433 |
| 5,477,679 | 12/1995 | Tatsumi et al. | 60/431 |
| 5,488,787 | 2/1996 | Aoyagi et al. | 37/348 |
| 5,542,490 | 8/1996 | Kemshall et al. | 180/422 |
| 5,678,982 | 10/1997 | Schwaiger | 417/44.2 |
| 5,680,929 | 10/1997 | Mouri et al. | 60/368 |

FOREIGN PATENT DOCUMENTS

| | | |
|---|---|---|
| 0 727 529 | 8/1996 | European Pat. Off. . |
| 2 633 987 | 1/1990 | France . |
| 4-53846 | 5/1992 | Japan . |

OTHER PUBLICATIONS

Patent Abstracts of Japan, vol. 95, No. 6, Jul. 31, 1995, JP 07–075383, Mar. 17, 1995.

Patent Abstracts of Japan, vol. 18, No. 386 (M–1641), Jul. 20, 1994, JP 06–107091, Apr. 19, 1994.

Patent Abstracts of Japan, vol. 96, No. 10, Oct. 31, 1996, JP 08–142688, Jun. 4, 1996.

Patent Abstracts of Japan, vol. 96, No. 10, Oct. 31, 1996, JP 08–151660, Jun. 11, 1996.

Patent Abstracts of Japan, vol. 95, No. 8, Sep. 29, 1995, JP 07–127095, May 16, 1995.

Patent Abstracts of Japan, vol. 96, No. 10, Oct. 31, 1996, JP 08–158404, Jun. 18, 1996.

*Primary Examiner*—Tan Nguyen

*Attorney, Agent, or Firm*—Oblon, Spivak, McClelland, Maier & Neustadt, P.C.

[57] ABSTRACT

There are provided an electric motor driven by (electric) power from a battery; a hydraulic pump driven by the electric motor; a hydraulic motor driven by operating oil discharged from the hydraulic pump; an operating member for performing a predetermined operation by the drive of the hydraulic motor; and operating levers for operating the operating member by switching a flow and a shut-off of the operating oil discharged from the hydraulic pump. The operating levers are operatable between a neutral position at which the hydraulic motor stops operation and an operating position at which the hydraulic motor operates. An accel-trimmer is provided to adjust the supply amount of power from the battery to the electric motor in the state where the operating levers are operated to the operating position.

13 Claims, 11 Drawing Sheets

BATTERY-DRIVEN HYDRAULIC EXCAVATOR

BACKGROUND OF THE INVENTION

1. Field of the Invention

The present invention relates to a battery-driven hydraulic excavator for performing various operations by electric power from a mounted battery.

2. Description of the Related Art

Japanese Utility Model Application Laid-Open No. Hei 4(1992)-53846 discloses a battery-driven type working machine for performing public works or the like by electric power from the battery. In this working machine, an electric motor is driven by electric power from the battery. A hydraulic pump is driven when the motor is driven. A hydraulic motor is driven by operating oil discharged from the hydraulic pump. The excavator is operated when the hydraulic motor is driven.

As compared with the working machine of an internal combustion engine type using an internal combustion engine such as a gasoline engine, a Diesel engine or the like as a driving source, the aforementioned battery-driven type working machine produces less noises and does not discharge exhaust gas. Therefore, such a working machine is suitable for operation in city areas where buildings are thickly settled.

Incidentally, in the battery-driven type working machine, since the storing ability of battery as an electric power source of an electric motor is not higher in energy conversion than the fuel storing ability of the internal combustion engine type working machine, the battery-driven type working machine cannot withstand the use for a long period of time, compared with the internal combustion engine type working machine. In the working machine disclosed in Japanese Utility Model Application Laid-Open No. Hei 4(1992)-53846 for solving the problem as noted above, switching between a battery power source and a commercial power source can be made. In this working machine, when the commercial power source is present in the operation spot, the commercial power source is used, and only when the commercial power source is not present, the battery power source is used.

However, for such a working machine, a very long lead wire is necessary to supply electric power from the commercial power source. Further, it is necessary that a device for winding the lead wire is mounted on the working machine so as not to get in the way of operation so that the lead wire may appear as the working machine moves. This increases the cost for the working machine. Further, when the machine is rotated, the lead wire gets entangles with an upper rotating body to impede workability.

Further, in the working machine disclosed in Japanese Utility Model Application Laid-Open No. Hei 4(1992)-53846, since the electric energy supplied from the battery to the electric motor cannot be adjusted, a fixed electric power is always supplied to the electric motor. Thereby, the operational speed of an operating member is constant under the same load. Accordingly, the operation according to the situation cannot be accomplished.

SUMMARY OF THE INVENTION

It is an object of the present invention to provide a battery-driven hydraulic excavator having a good workability.

It is a further object of the present invention is to provide a battery-driven hydraulic excavator which makes a commercial power source unnecessary and can continue operation for a long period of time.

It is another object of the present invention is to provide a battery-driven hydraulic excavator which can adjust the operational speed of an operating member according to the situation.

The present invention relates to a battery-driven hydraulic excavator. This hydraulic excavator comprises a lower carriage and an upper rotating body provided rotatably about a vertical shaft on the lower carriage. On the upper rotating body are mounted a battery, an electric motor driven by electric power from the battery, and a hydraulic pump driven by the electric motor. Operating oil discharged from the hydraulic pump drives actuators, and the actuators in turn drive an operating member. An operating lever switches between flow and shutoff of operating oil discharged from the hydraulic pump and moves the operating member through the actuators. The operating lever and the operating member are mounted on the upper rotating body.

In the battery-driven hydraulic excavator according to the present invention, since the battery mounted on the upper rotating body functions as a driving source, a lead wire connected to a commercial power source is not necessary. Therefore, in the hydraulic excavator, even if the upper rotating body is rotated, the lead wire is not entangled with the upper rotating body. For this reason, an operator can devote himself to operation, thus enhancing workability.

Further, it will be preferable if the operating lever can be operated between a neutral position at which the operating member stops its operation and an operating position at which the operating member operates.

Further, an amount of power supply from the battery to the electric motor may be set by an accel-trimmer or the like. In this case, in the state where the operating lever is set to the operating position, electric power according to the set amount is supplied to the electric motor whereby the electric motor rotates at a rotational speed according to the set amount. The operating member operates at an operational speed according to the set amount though the actuator by the operation of the hydraulic pump operated at a speed according to the rotational speed. In this way, the operational speed of the operating member can be adjusted by the setting operation of setting means so that the operational speed of the operating member can be changed according to the operating situation. This is therefore more effective.

Alternatively, the operating amount of the operating lever at the operating position of the operating lever may be detected so that the electric power is supplied from the battery to the electric motor according to the state where the operating lever is operated to the operating position. In this case, the operational speed of the operating member can be adjusted according to the operation of the operating lever. This is therefore more effective.

Further, alternatively, in the state where all the operating levers are set to a neutral position, a supply of power from the battery to the electric motor is stopped, and in the state where at least one operating lever is set to an operation position, the power may be supplied to the electric motor. In this case, an inconvenience can be avoided in which when any of operating members are not operated, the electric motor is driven to consume wasteful electric power. Further, since the electric power supplied to the electric motor is controlled according to the total operating amount of the operating levers, adequate power consumption can be always realized in proper quantities.

Further, an operation mode setting unit for changing a supply amount of electric power to an electric motor according to the kind of operations is provided so that the electric power supplied from the battery to the electric motor may be changed according to the operation mode. In this case, in the excavation operation or the like, the operating member can be sensitively reacted with the operation of the operating lever, and in the finishing operation, the operating member cannot be sensitively reacted with the operation of the operating lever. The kind of operations is input into the operation mode setting unit whereby the operating lever can be always operated in the optimal condition, and workability is enhanced. In addition, since the excessive operation can be suppressed, wasteful consumption of battery power can be suppressed.

DESCRIPTION OF THE PREFERRED EMBODIMENTS

Figure 1:
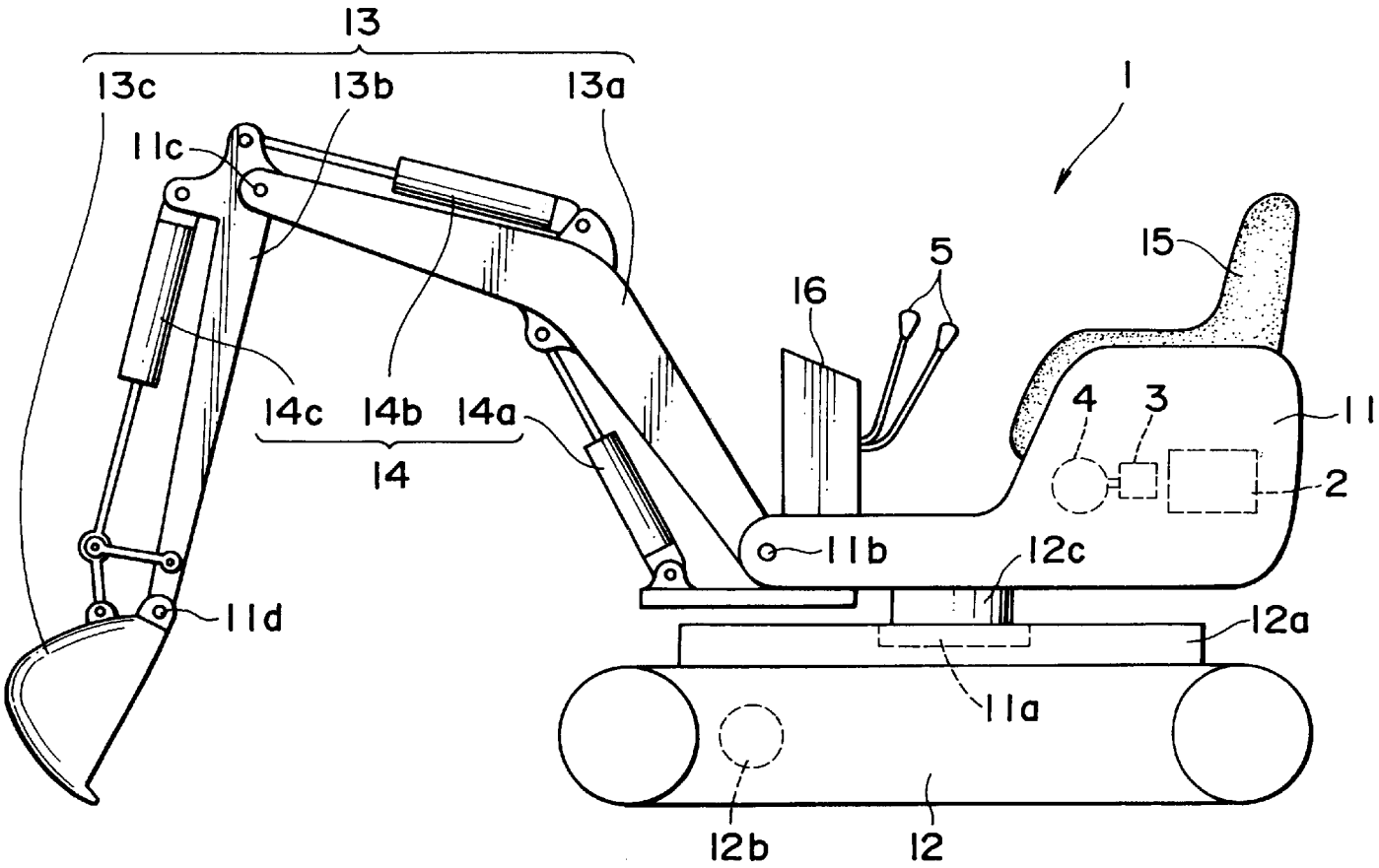
FIG. 1 is a side view showing one embodiment of the working machine according to the present invention.

FIG. 1 is a side view showing one embodiment of the working machine according to the present invention;

FIG. 1 shows a small excavator as a working machine. This excavator 1 has an operator's section 11 in which an operator boarded operates. Movable crawlers 12 are provided on the bottom of the operator's section 11. An operating member 13 which is freely bent by the drive of an actuator 14 is provided in front of the operator's section 11. The crawlers 12 are provided on both sides (both sides vertical to the paper surface of FIG. 1) of a base bed 12*a* for supporting them. The operator's section 11 is supported rotatably around a vertical shaft 12*c* stood upright in the center of the base bed 12*a*.

A direction changing actuator 11*a* for rotating the operator's section 11 around the vertical shaft 12*c* is provided on the base bed 12*a*. The operator's section 11 can change the horizontal direction with respect to the crawler 12 by the operation of the actuator 11*a*. The crawlers 12 are turned around by a hydraulic motor 12*b* provided on the base bed 12*a*, whereby the excavator 1 can move forward and backward, and change the direction.

The operating member 13 comprises an arm 13*a* on the proximal end side supported rotatably around a horizontal shaft 11*b* at the front end of the operator's section 11, an arm 13*b* on the extreme end side provided free to bend on the extreme end of the arm 13*a* on the proximal end side, and a bucket 13*c* provided free to bend on the extreme end of the arm 13*b* on the extreme end side. The actuator 14 comprises a proximal end actuator 14*a* for rotating the arm 13*a* on the proximal end side around a horizontal shaft 11*b*, an intermediate actuator 14*b* for rotating the arm 13*b* on the extreme end side around a horizontal shaft 11*c*, and an extreme end actuator 14*c* for rotating the bucket 13*c* around a horizontal shaft 11*d*.

A battery 2 is mounted within the operator's section 11. An electric motor 3 driven merely by electric power from the battery 2 is provided within the operator's section 11. A hydraulic pump 4 driven by the electric motor 3 is also provided within the operator's section 11. Within the operator's section 11 and the base bed 12*a* are provided the actuators 14*a*, 14*b*, 14*c*, 11*a* and a plurality of circulating systems for feeding oil pressure generated by the drive of the hydraulic pump 4 to the hydraulic motor 12*b*. A plurality of switching valves for switching the direction of operating oil in the hydraulic systems and stopping the operating oil are also provided on the operator's section 11 and the base bed 12*a*.

At the rear (rightward in FIG. 1) of the operator's section 11 is provided an operator's seat 15 on which an operator sits to operate the excavator 1. An operating stand 16 opposed to the operator's seat 15 is stood upright at the front of the operator's section 11. The operating stand 16 is provided with a plurality of operating means 5 (levers) corresponding to the hydraulic motor 12*b* and the actuators 14*a*, 14*b*, 14*c*, 11*a*. By operating these operating means 5, the operating oil to the actuators 14*a*, 14*b*, 14*c*, 11*a* and the hydraulic motor 12*b* is supplied or stopped to be supplied through the corresponding switching valves. Thereby, the actuators 14*a*, 14*b*, 14*c*, 11*a* and the hydraulic motor 12*b* are driven or stopped.

Figure 2:
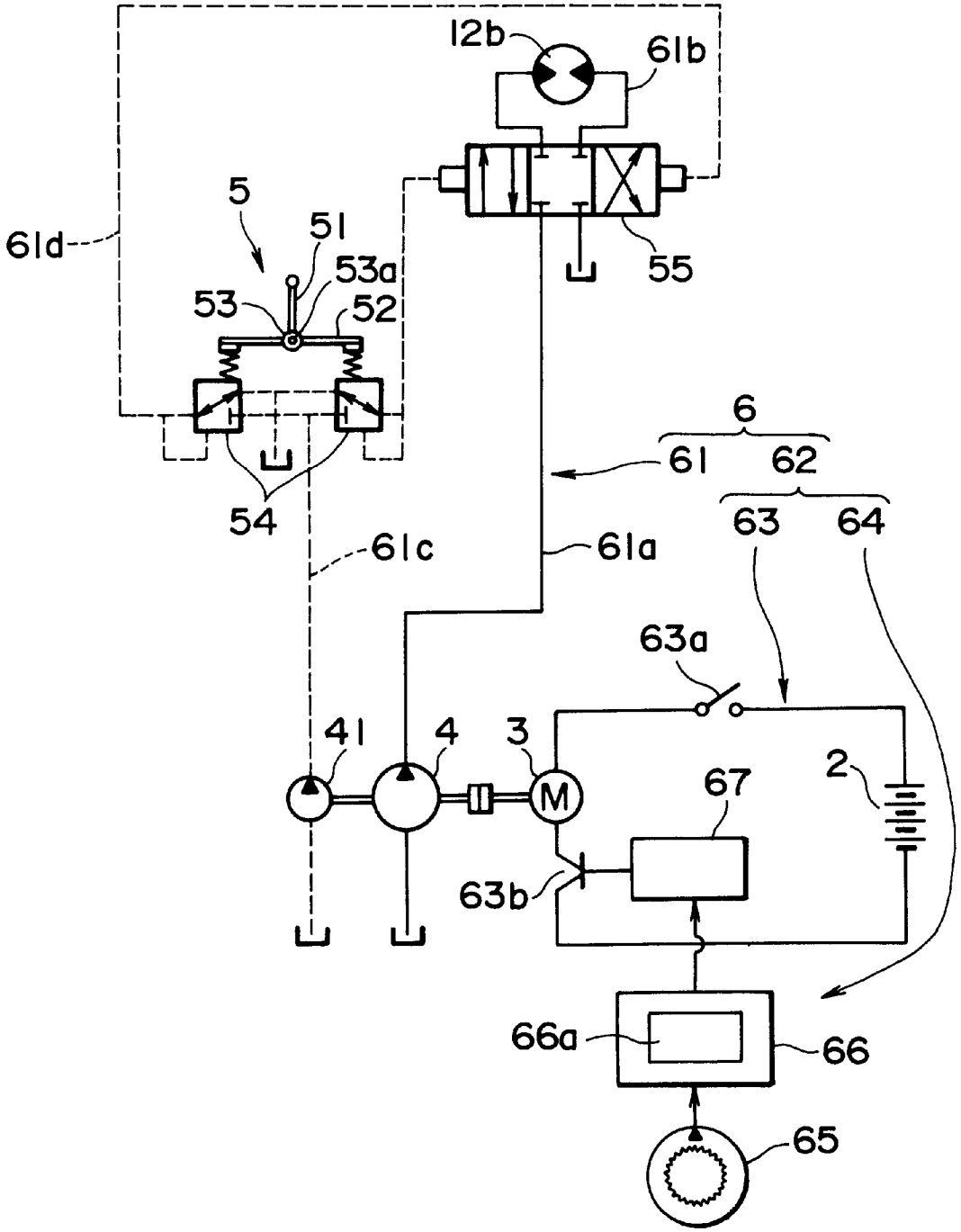
FIG. 2 shows a hydraulic circuit for explaining a control system in a first embodiment according to the present invention.

FIG. 2 shows a hydraulic circuit for explaining a control system in a first embodiment according to the present invention.

In FIG. 2, out of a plurality of hydraulic systems, only the system relating to the hydraulic motor 12*b* is shown for the sake of simplification. In the case of the hydraulic system relating to the operating member 13, the arm on the proximal end side 13*a*, the arm on the extreme end side 13*b* and the bucket 13*c* in place of the hydraulic motor 12*b* are arranged at a position of the hydraulic motor 12*b*. As shown in FIG. 2, a driving system 6 is formed from a hydraulic system 61 and an electric system 62. The hydraulic system 61 comprises the hydraulic pump 4, a pilot pump 41 coaxial with the hydraulic pump 4, the operating means 5, a directional control valve 55, and the hydraulic motor 12*b*. The hydraulic pump 4 rotates the hydraulic motor 12*b* by the operating oil discharged therefrom. The directional control valve 55 is switched by pilot oil discharged from the pilot pump 41.

A first hydraulic pipe 61*a* is disposed between the hydraulic pump 4 and the directional control valve 55. A second hydraulic pipe 61*b* is disposed between the directional control valve 55 and the hydraulic motor 12. The operating oil discharged from the hydraulic pump 4 flows passing through the first hydraulic pipe 61*a* and the second hydraulic pipe 61*b* when the directional control valve 55 is opened. Thereby, the hydraulic motor 12*b* disposed in the second hydraulic pipe 61*b* rotates in a predetermined direction. On the other hand, when the directional control valve 55 stops, the rotation of the hydraulic motor 12*b* stops.

A first pilot pipe 61*c* is disposed between the pilot pump 41 and the operating means 5. A second pilot pipe 61*d* is disposed between the operating means 5 and a pilot port of the directional control valve 55. The pilot oil discharged from the pilot pump 41 and reached the operating means 5 through the first pilot pipe 61*c* is switched in the supply direction to the second pilot pipe 61*d* by the operation of the operating lever 51. Thereby, the directional control valve 55 is set in position according to the operation of the hydraulic motor 51. Thereby, the hydraulic motor 12*b* rotates in a predetermined direction. The rotation of the hydraulic motor 12*b* is stopped by setting the operating lever 51 to a neutral position.

The operating means 5 is provided with an operating lever 51 projected upward from the operating stand 16. This operating lever 61 is in the form of a rod, and has a bearing portion 53 provided at the proximal end. A support shaft 53*a* is fitted into the bearing portion 53. The operating lever 51 is supported rotatably around the support shaft 53*a*.

The bearing portion 53 is provided with a lateral lever 52 extending in a lateral direction. A pair of switching valves 54 are provided through coil springs at lower parts on both sides of the lateral lever 52. Ordinarily, the operating means 5 is set to a neutral position by the bias force of the coil spring. In the state where the operating means 5 is at a neutral position, the directional control valve 55 is set to an operating oil shut-off position as shown in FIG. 2. In the state where the operating means 5 is at a neutral position, the hydraulic motor 12*b* assumes a stop state When the operating lever 51 is pulled down rightward around the support shaft 53*a*, the pilot oil from the pilot pump 41 is supplied to the first pilot pipe 61*c*, the right switching valve 54 and the second pilot pipe 61*d*. Thereby, the directional control valve 55 moves rightward, so that the operating oil from the hydraulic pump 4 is supplied from the left-hand of the hydraulic motor 12*b* and the hydraulic motor 12*b* rotates in forward direction. The crawlers 12 rotate in forward direction by the rotation of the hydraulic motor 12*b* and the excavator 1 moves forward.

When the operating lever 51 is pulled down leftward in the state shown in FIG. 2, the pilot oil from the pilot pump 41 is supplied to the first pilot pipe 61*c*, the left switching valve 54 and the second pilot pipe 61*d*. Thereby, the directional control valve 55 moves leftward, and the operating oil from the hydraulic pump 4 is supplied rightward of the hydraulic motor 12*b* so that the hydraulic motor 12*b* rotates in the reverse direction. The crawlers 12 rotate in the reverse direction by the rotation of the hydraulic motor 12*b* and the excavator 1 moves back.

The electric system 62 comprises a loop circuit 63 having the battery 2 and the electric motor 3 connected in series, and a control circuit 64 for controlling a DC pulse of the loop circuit 63. The control circuit 64 is provided with a accel-trimmer 65 as an operating knob for setting an operation speed of the hydraulic motor 12*b*, a control means 66 for outputting a predetermined control signal on the basis of the rotation operating amount of the accel-trimmer 65, and a chopper circuit 67 for outputting a pulse signal to the loop circuit 63 on the basis of a control signal from the control means 66.

The loop circuit 63 is provided with a key switch 63*a* and a transistor (switch element) 63*b*. A base of the transistor 63*b* is connected to the chopper circuit (duty ratio control means) 67. The key switch 63*a* is turned on when the excavator 1 is operated. When the key switch 63*a* is turned on, electric power from the battery 2 is supplied to the electric motor 3 to drive the latter.

The chopper circuit 67 is provided to intermittently output the input DC current at a fixed period. In the present embodiment, a voltage pulse having a pulse width on the basis of a control signal from the control means 66 is output.

The accel-trimmer 65 is operated according to the situation while visually watching the operating condition when the operator operates the excavator 1. The accel-trimmer 65 is provided at a suitable location of the operating stand 16 so as to oppose to the front of the operator seated on the operator's seat 15. The operator holds the accel-trimmer 65 by his fingers for operation in the state where the operating means 5 is operated to the operating position, whereby the rotational amount is input to the control means 66 as an analog signal. The rotational speed of the hydraulic motor 12*b* is in accordance with the operating amount of the accel-trimmer 65. Thereby, delicate operation can be done according to the situation of the spot.

The control means 66 is provided to control the whole operation of the excavator 1. A power-supply control portion 66*a* is provided to control the electric energy supplied to the electric motor 3 of the operating lever 51. The power-supply control portion 66*a* outputs a control signal to the chopper circuit 67 so as to obtain the duty ratio according to the rotation operating amount of the accel-trimmer 65.

The chopper circuit 67 is provided to intermittently output a signal by which the voltage pulse is to be the aforementioned duty ratio to the base of the transistor 63*b*. The transistor 63*b* accepting the signal from the chopper circuit 67 is turned on and off at a predetermined timing. Thereby, the pulse voltage of the aforesaid duty ratio is applied to the electric motor 3 and the electric power according to the rotation operating amount of the accel-trimmer 65 is supplied to the electric motor 3 on the average. Thereby, the electric motor 3 rotates at r.p.m. according to the rotation operating amount of the accel-trimmer 65. The flow rate of the operating oil discharged to the first hydraulic pipe 61*a* is depends on the rotation operating amount of the accel-trimmer 65 by the hydraulic pump 4 operated by the electric motor 3. As a result, the rotational speed of the hydraulic motor 12*b* depends on the operating amount of the accel-trimmer 65. Accordingly, the moving speed of the excavator 1 is at a predetermined speed according to the operating amount of the accel-trimmer 65.

Figures 3A, 3B, 3C, 3D:
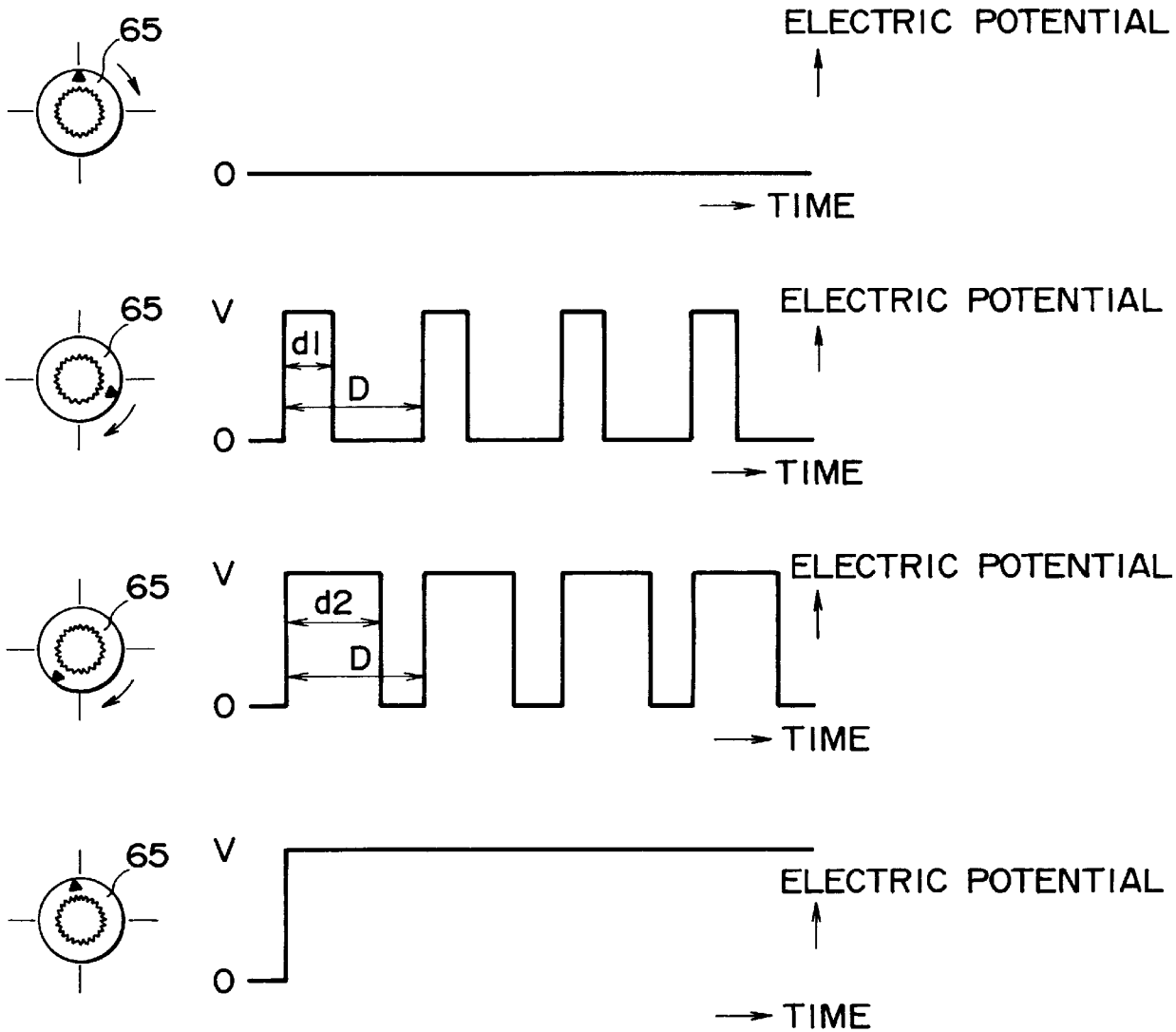
FIG. 3 is a waveform illustrating a relationship between an operating amount of an accel-trimmer and a pulse voltage applied to an electric motor.

FIG. 3 is a waveform illustrating a relationship between an operating amount of the accel-trimmer 65 and a pulse voltage applied to the electric motor 3. (A) designates the state set to a home position before the accel-trimmer 65 is operated. (B) designates the state in which the accel-trimmer 65 is operated by 30% (approximately 110°) of the total rotation operating amount (360°). (C) designates the state in which the accel-trimmer 65 is operated by the total rotation operating amount.

First, in the state set in which the accel-trimmer 65 is set to a home position as shown in FIG. 3 (A), an operation signal of the rotation operating amount "0" is input to the power-supply control portion 66*a* of the control means 66. In the power-supply control portion 66*a*, when the control signal is "0", a signal from the chopper circuit 67 is not output to the base of the transistor 63*b*. In this state, the transistor 63*b* is turned off. Thereby, electric power from the battery 2 is not supplied to the loop circuit 63, as shown in FIG. 3 (A). Accordingly, the electric motor 3 is not driven.

Next, when the accel-trimmer 65 is operated by 30% with respect to the total operating amount (that is, approximately 110° clockwise from the home position) as shown in FIG. 3 (B), a pulse width d1 of the voltage pulse is in the state where set to 30% with respect to a period D of a pulse voltage (d1/D=0.3). That is, a control signal such that the duty ratio is 0.3 by the arithmetic operation at the power-supply control portion 66*a* on the basis of the rotation operating amount of the accel-trimmer 65 is output to the chopper circuit 67. The transistor 63*b* is turned on and off so as to have 0.3 of the duty ratio by the pulse signal from the chopper circuit 67, whereby the pulse voltage as shown in FIG. 3 (B) is applied. Thereby, the average with time of current flowing through the loop circuit 63 is 30% of an electromotive force of the battery 2. The electric motor 3 rotates at the rotational speed corresponding to the voltage value thereof.

Then, when the rotation operating amount of the accel-trimmer 65 is set to 60° (approximately 220°) with respect to the total rotation operating amount, as shown in FIG. 3 (C), a pulse width d2 of the voltage pulse is in the state set to 60% with respect to a period D of the pulse voltage (d2/D=0.6). Thereby, the average value with time of current flowing through the loop circuit 63 is 60% of an electromotive force of the battery 2. The electric motor 3 rotates at the faster rotational speed than that of the case where the previous duty ratio is 0.3.

Further, when the accel-trimmer 65 is operated to the maximum (360°), as shown in FIG. 3 (D), a signal is always output from the chopper circuit 67 to the transistor 63*b*. Thereby, the electromotive force of the battery 2 is applied to all the electric motors 3. The electric motor 3 rotates at the maximum rotational speed.

As described in detail above, in the excavator 1 according to the present embodiment, the electric motor 3 is used, in place of the internal combustion engine, as a driving source. Further, the electric motor 3 is driven by the electric power from the battery 2 mounted whereby the excavator 1 is run and the operation by the operating member 13 is done. The excavator 1 according to the present embodiment does not generate large noises and does not discharge exhaust gases as compared with that using the internal combustion engine. The excavator 1 according to the present invention is suitable for public works in a city area.

In the state where the accel-trimmer 65 is set to a home position, the amount of power supply from the battery 2 to the electric motor 3 is "0". When the accel-trimmer 65 is operated, electric power according to the rotation operating amount is supplied from the battery 2 to the electric motor 3. Therefore, the operating speed of the operating member 13 can be adjusted according to the situation of the operation to enhance the workability as compared with the case where fixed power is always supplied to the electric motor 3.

Further, the transistor 63*b* is turned on and off at the duty ratio according to the rotation operating amount of the accel-trimmer 65 by the function of the power-supply control portion 66*a* and the chopper circuit 67, and therefore the electric motor 3 rotates at the rotational speed according to the operating amount of the accel-trimmer 65. Thereby, the operating member 13 and the hydraulic motor 12*b* are operated at the speed corresponding to the operating amount of the accel-trimmer 65. In the present embodiment, since power is supplied to the electric motor 3 by PWM control (pulse width modulation control) without intervention of a variable resistor and a transset, wasteful power is not consumed by the variable resistor or the like. Therefore, it is possible to extend the service life of the battery 2, and the excavator 1 can be operated for long periods.

Figure 4:
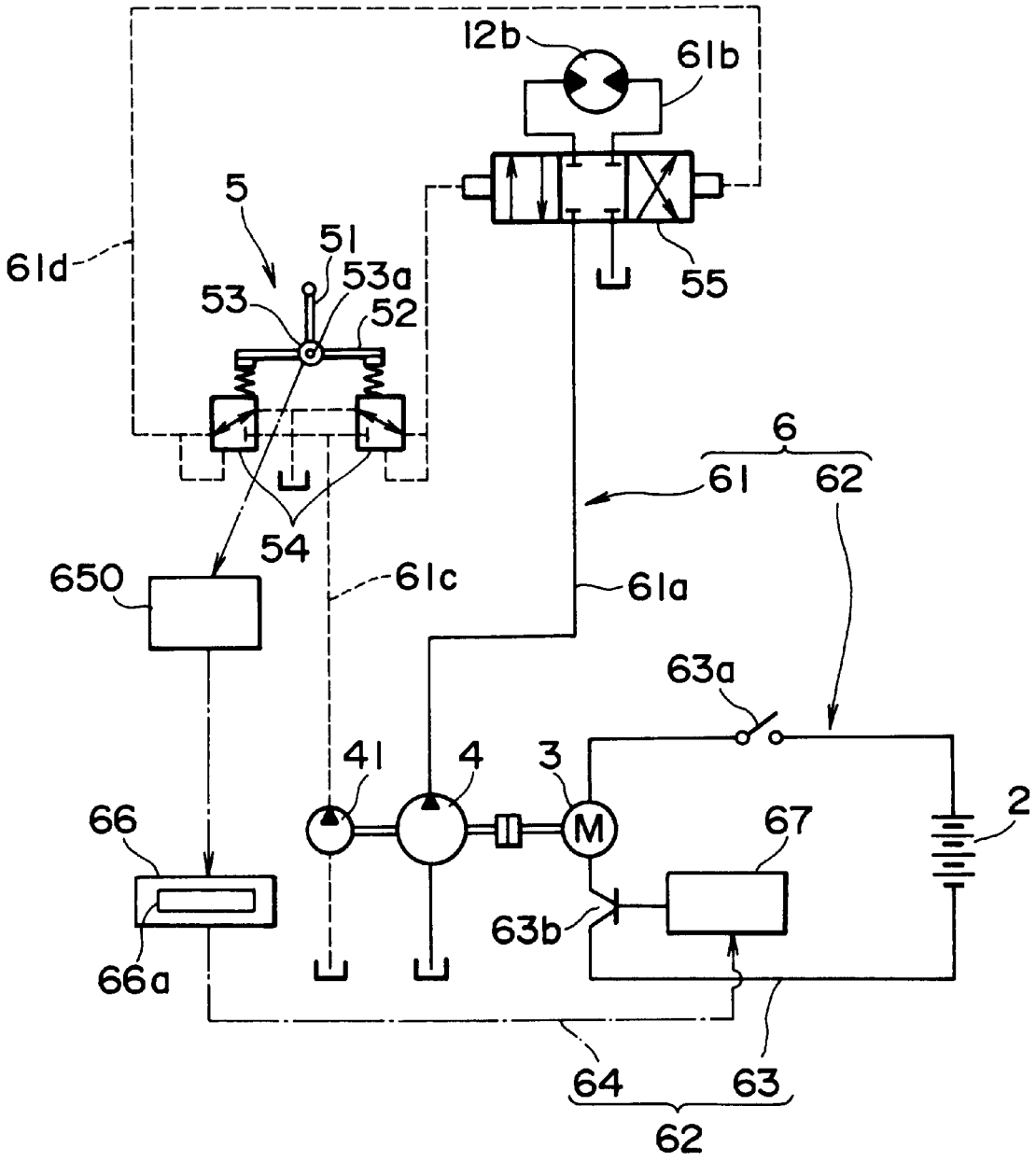
FIG. 4 shows a hydraulic circuit for explaining a control system in a second embodiment according to the present invention.

FIG. 4 shows a hydraulic circuit for explaining a control system in a second embodiment according to the present invention.

In the second embodiment, in place of the accel-trimmer 65 in the first embodiment, the operating amount of the operating lever 51 is detected to thereby control the power supply amount to the electric motor 3 according to the detected amount.

That is, the operating means 5 is provided with an operating angle sensor 650 for detecting an operating angle (operating amount) of the operating lever 51. The detected result of the operating angle sensor 650 is input to the control means 66. The operating angle sensor 650 detects a tilt angle when the operating lever 51 is tilted back and forth with an upright position thereof as a reference. The detected result of the operating angle sensor 650 is input to the control means 66 as an analog signal caused by a current value or a voltage value.

A control signal is output from the power-supply control portion 66*a* to the chopper circuit 67 so as to obtain the duty ratio according to the current value or voltage value detected by the operating angle sensor 650.

The chopper circuit 67 intermittently outputs a signal for accomplishment of the duty ratio to the base of the transistor 63*b*. Thereby, the transistor 63*b* is turned on and off at a predetermined timing. Thereby, a pulse voltage of said duty ratio is applied to the electric motor 3. Thereby, the electric motor 3 rotates at r.p.m. according to the operating amount of the operating lever 51. The flow rate of the operating oil discharged to the first hydraulic pipe 61*a* by the hydraulic pump 4 operated by the electric motor 3 depends on the operating amount of the operating lever 51. As a result, the rotational speed of the hydraulic motor 12*b* depends on the operating amount of the operating lever 51.

Figures 5A, 5B, 5C, 5D:
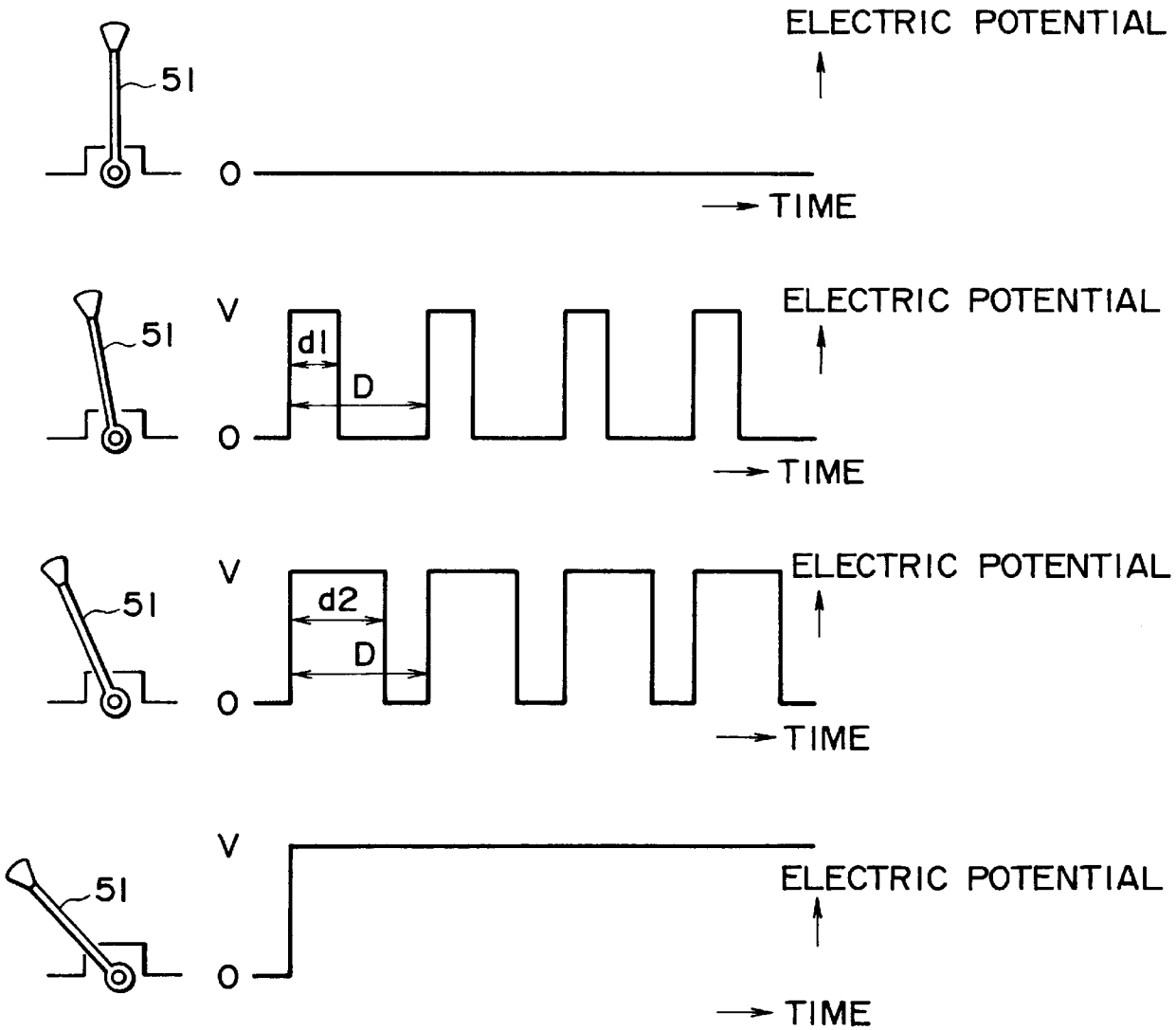
FIG. 5 is a waveform illustrating a relationship between an operating amount of an operating lever and a pulse voltage flowing through a loop circuit.

FIG. 5 is a waveform illustrating a relationship between an operating amount of the operating lever 51 and a pulse voltage flowing through the loop circuit 63. (A) designates the state where the operating lever 51 is set to a neutral position. (B) designates the state where the operating lever 51 is operated 30% of the total operating amount. (C) designates the state where the operating lever 51 is operated 60% of the total operating amount of the operating lever 51. (D) designates the state where the operating lever 51 is operated the total operating amount.

First, in the state where the operating lever 51 is set to a neutral position, as shown in FIG. 5 (A), the operating angle sensor 650 detects "0". The detected signal is input to the power-supply control portion 66*a* of the control means 66. When the detected signal is "0", no signal is output from the chopper circuit 67 to the base of the transistor 63*b*. Therefore, the transistor 63*b* is turned off. Thereby, power is not supplied from the battery 2 to the loop circuit 63, as shown in FIG. 5 (A). Accordingly, the electric motor 3 is not driven, and the power of the battery is not consumed.

Then, when the operating lever 51 is operated 30% with respect to the total operating amount, as shown in FIG. 5 (B), the pulse width d1 of the voltage pulse assumes the state set to 30% with respect to a period D of the pulse voltage (d1/D=0.3). In this case, a control signal such that the duty ratio is 0.3 by the arithmetic operation by the power-supply control portion 66*a* on the basis of the detected result of the operating angle sensor 650 is output to the chopper circuit 67. The transistor 63*b* is turned on and off by the pulse signal from the chopper circuit 67 so that the duty ratio is 0.3. The pulse voltage as shown in FIG. 5 (B) is applied to the electric motor 3. Thereby, the average value with time of current flowing through the loop circuit 63 is 30% of the electromotive force of the battery 2. The electric motor 3 rotates at the rotational speed corresponding to the voltage value.

When the operating amount of the operating lever 51 is set to 60% with respect to the total operating amount, as shown in FIG. 5 (C), the pulse width d2 of the voltage pulse assumes the state set to 60% with respect to the period D of the pulse voltage (d2/D=0.6). Thereby, the average value with time of current flowing through the loop circuit 63 is 60% of the electromotive force of the battery 2. The electric motor 3 rotates at faster rotational speed than that of the case where the previous duty ratio is 0.3.

When the operating lever 51 is set to the maximum, as shown in FIG. 5 (D), a signal is always output from the chopper circuit 67 to the transistor 63*b*. Thereby, the electromotive force of the battery 2 is applied to the electric motor 3. The electric motor 3 rotates at the maximum rotational speed.

According to the control system in the second embodiment, it is possible to control the power from the battery 2 supplied to the electric motor merely by the operation of the operating lever 51 without rotating the accel-trimmer 65, thus enhancing the workability.

Figure 6:
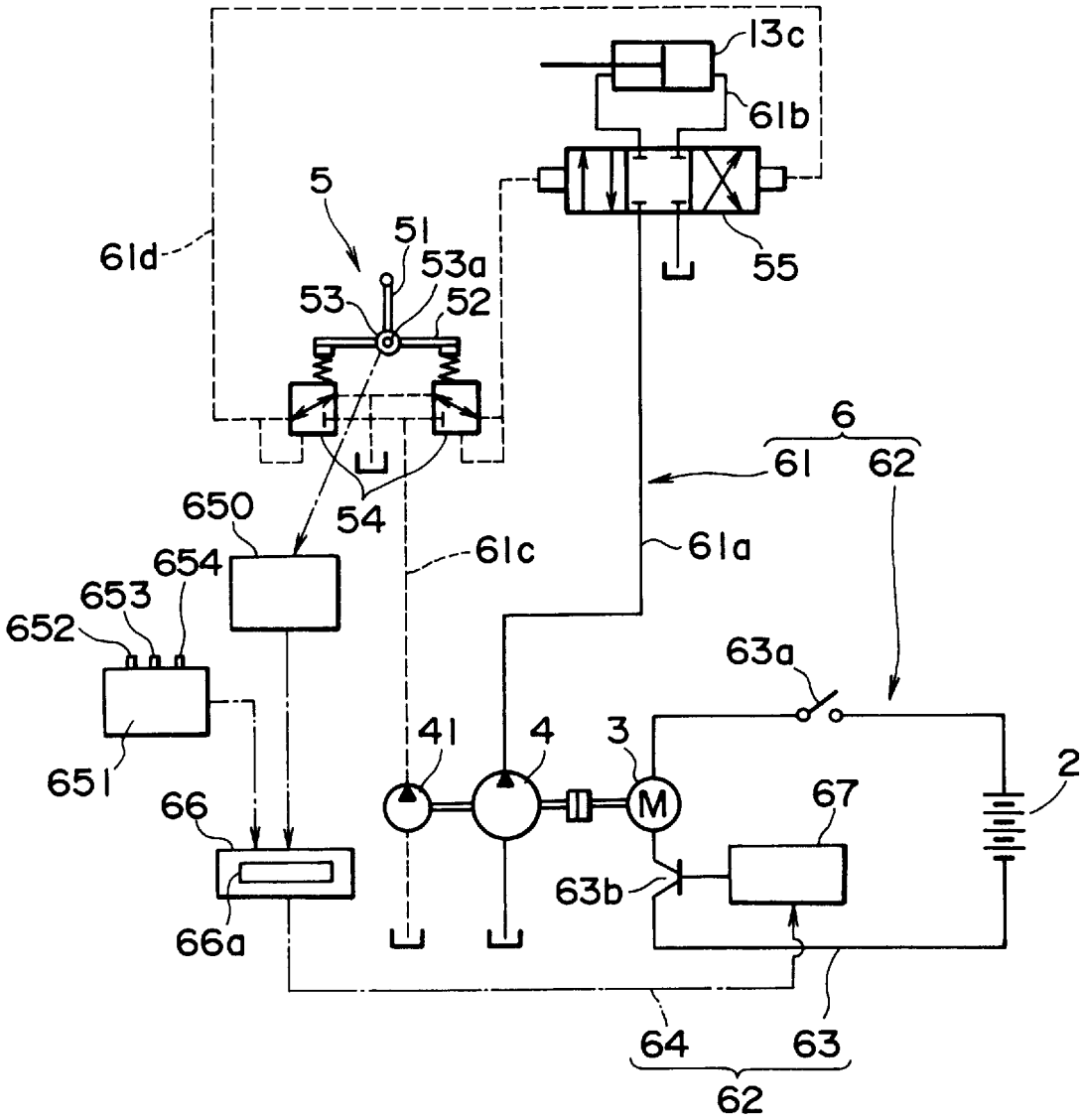
FIG. 6 shows a hydraulic circuit for explaining a control system in a third embodiment according to the present invention.

FIG. 6 shows a hydraulic circuit for explaining a control system in a third embodiment according to the present invention.

In the third embodiment, in addition to the control according to the detected amount by the detection of the operating amount of the operating lever 51 in the second embodiment by means of the operating angle sensor 650, the operating member 13 is controlled according to the operating mode. In FIG. 6, out of hydraulic systems for a plurality of operating members 13, only the system for the extreme end actuator 14*c* is shown in FIG. 6.

As shown in FIG. 6, a first pilot pipe 61*c* is disposed between the pilot pump 41 and the operating means 5. A second pilot pipe 61*d* is provided between the operating means 5 and the directional control valve 55. Pilot oil is discharged from the pilot pump 41 and arrives at the operating means 5 through the first pilot pipe 61*c*. The direction of supplying the pilot oil to the second pilot pipe 61*d* is switched by the operation of the operating lever 51. Thereby, the extreme end actuator 14*c* is operated in a predetermined direction. When the operating lever 51 is set to a neutral position, the operation of the extreme end actuator 14*c* stops.

In the state where the operating means 5 is in a neutral position, the directional control valve 55 shuts off the pilot oil as shown in FIG. 6. Thereby, the extreme end actuator 14*c* is in a stop state.

When the operating lever 51 is pulled down rightward around the support shaft 53*a*, the pilot oil from the pilot pump 41 is supplied to the first pilot pipe 61*c*, the light switching valve 54 and the second pilot pipe 61*d*. Thereby, the directional control valve 55 moves rightward so that the operating oil from the hydraulic pump 4 is supplied from the left hand in FIG. 6 of the extreme end actuator 14*c*. The actuator 14*c* is operated so that its piston rod is moved into the cylinder. The bucket 13*c* is rotated clockwise around the horizontal shaft 11*d* by the operation of the actuator 14*c*.

When the operating lever 51 is pulled down leftward, conversely to the former, the pilot oil from the pilot pump 41 is supplied to the first pilot pipe 61*c*, the left switching valve 54 and the second pilot pipe 61*d*. Thereby, the directional control valve 55 moves leftward so that the operating oil from the hydraulic pump 4 is supplied from the right hand in FIG. 6 of the extreme end actuator 14*c*, and the extreme end actuator 14*c* operates in the reverse direction. The operation of the extreme end actuator 14*c* causes the bucket 13*c* to scoop earth on the surface of the earth or under the ground.

The control circuit 64 is provided with an operating angle sensor 65 for detecting an operating angle (an operating amount) of the operating lever 51, an operating mode setting unit 651 for setting an operating mode executed by the extreme end actuator 14*c*, and a control means 66 for outputting a predetermined control signal to the loop circuit 63 on the basis of the detected result of the operating angle sensor 65 and the mode set by the operating mode setting unit 651.

The operating mode setting unit 651 is capable of inputting the kinds of operations of the operating member 13, that is the operating mode. The operating modes include an excavation mode (Mode A) for deeply digging up the ground by the bucket 13*c*, a land readjustment mode for readjusting the rugged portions on the ground by the bucket 13*c* (Mode B), and a finishing mode for smoothing and flattening the readjusted surface of the earth by the back of the bucket 13*c* or using the bucket 13*c* as a crane (Mode C). The operating mode setting unit 651 is provided with an excavation mode button 652, an land readjustment mode button 653, and a finishing mode button 654. A mode is set by depressing either button.

The power-supply control portion 66*a* outputs a control signal according to the operating amount of the operating lever 51 and the operating mode set by the operating mode setting unit 651 to the chopper circuit 67.

Figure 7:
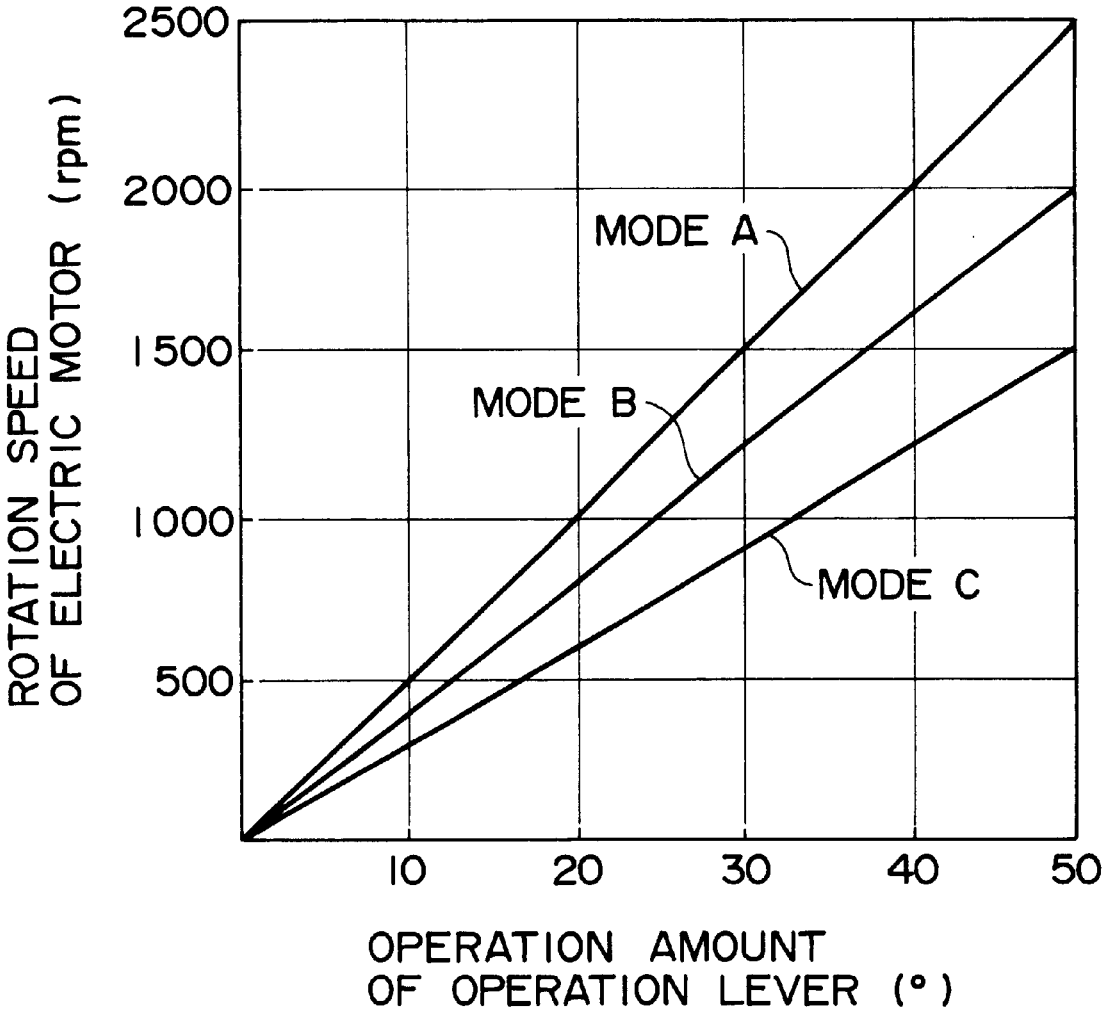
FIG. 7 is a graph illustrating a relationship between an operating amount of an operating lever and the number of revolutions of an electric motor.

FIG. 7 is a graph illustrating a relationship between an operating amount (°) of the operating lever 51 and the rotation speed (rpm) of the electric motor 3.

As shown in the graph, the rpm of the electric motor 3 increases or decreases in proportion to the operating amount of the operating lever 51. The change rate of the rpm of the electric motor 3 with respect to the operating amount of the operating lever 51 increases in order of the finishing mode (Mode C), the land readjustment mode (Mode B) and the excavation mode (Mode A). In the example shown in FIG. 7, the change rate of the finishing mode is 30 (rpm/°), that of the land readjustment mode is 40 (rpm/°), and that of the excavation mode is 50 (rpm/°).

The reason why the change rate of the rpm of the electric motor 3 with respect to the operating amount of the operating lever 51 according to the operating mode is differentiated will be explained below. In the excavation mode, since the ground is dug up by the bucket 13*c*, a great force is required when the extreme end of the bucket 13*c* is contacted to the earth. Further, it is necessary to sensitively reflect a small operating amount of the operating lever 51 on the motion of the bucket 13*c* in order that the extreme end of the bucket 13*c* once contacts to the ground has to be pulled out of the ground quickly. On the other hand, in the finishing mode, since the readjusted surface of the earth is merely smoothed by the back portion of the bucket 13*c*, if the bucket 13*c* is sensitively reacted with the operating amount of the operating lever 51, the operation is difficult to perform conversely. Further, in the land readjustment mode, since it is an intermediate operation between the excavation mode and the finishing mode, an intermediate value between the excavation mode and the finishing mode is employed as the change rate.

The control means 66 is designed to output a control signal according to the operating mode set by the operating mode setting unit 651 to the chopper circuit 67. The control signal controls in duty ratio the power supplied from the battery 2 to the electric motor 3.

Accordingly, the chopper circuit 67 having the control signal input intermittently outputs a signal by which the duty ratio is achieved to the base of the transistor 63*b*. Therefore, the transistor 63*b* is turned on and off at a predetermined timing. Thereby, a pulse voltage having the aforesaid duty ratio is applied to the electric motor 3 to assume the state where power according to the operating amount of the operating lever 51 is supplied to the electric motor 3 on the average.

Thereby, the electric motor 3 rotates at the rpm according to the operating amount of the operating lever 51 in the operating mode set, and the flow rate of the operating oil discharged to the hydraulic pipe 61 by the hydraulic pump 4 operated by the electric motor 3 is also in accordance with the operating amount of the operating lever 51. As a result, the operating speed of the extreme end actuator 14*c* is in accordance with the operating amount of the operating lever 51 in the operating mode set. Accordingly, the operating speed of the extreme end actuator 14*c* is determined according to the operating amount of the operating lever 51 in the mode as described.

Figures 8A, 8B, 8C, 8D:
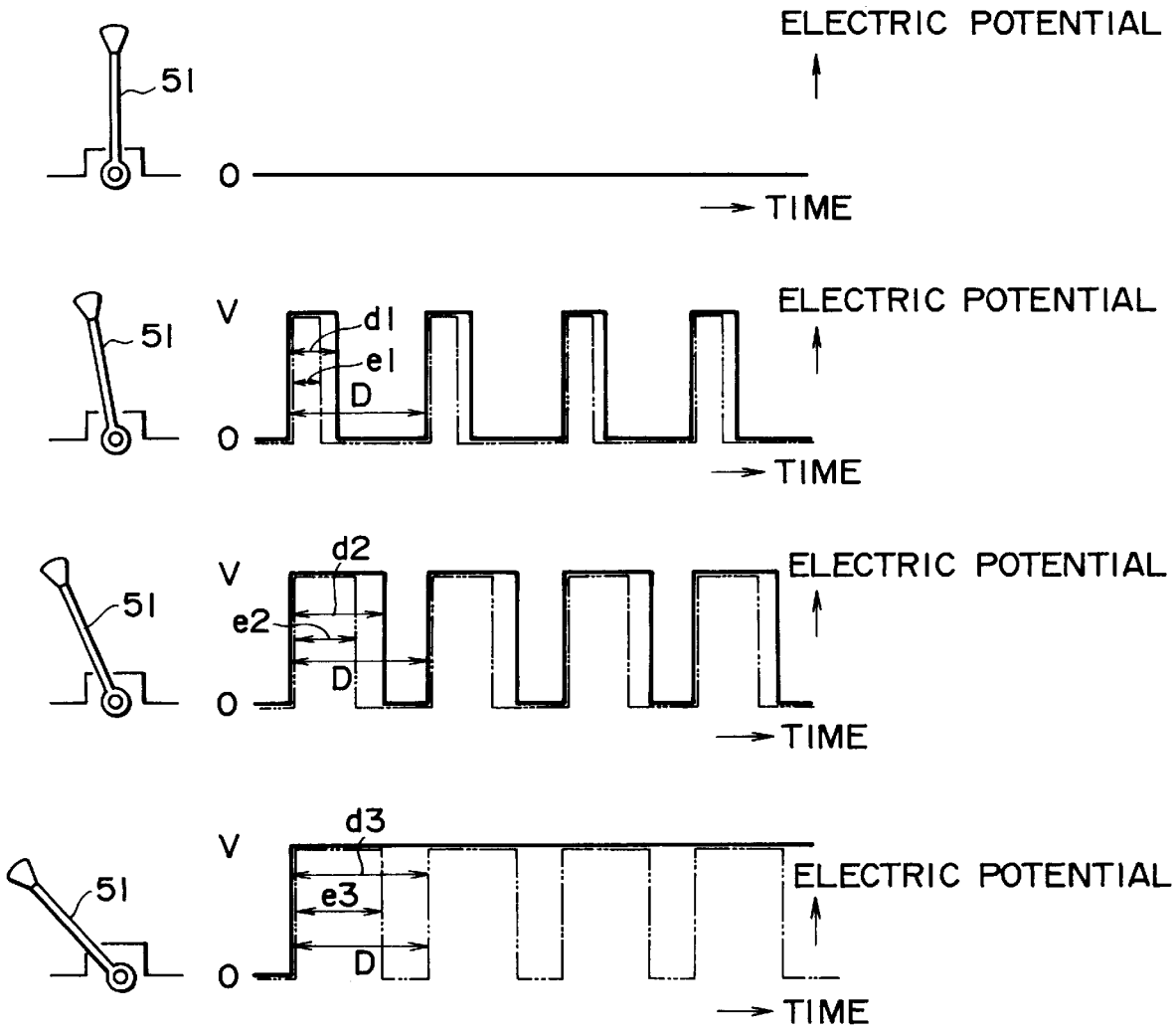
FIG. 8 is a waveform illustrating a relationship between an operating amount of an operating lever and a pulse voltage flowing through a loop circuit.

FIG. 8 is a waveform illustrating a relationship between an operating amount of the operating lever 51 and a pulse voltage flowing through the loop circuit 63. (A) designates the state where the operating lever 51 is in a neutral position. (B) designates the state where the operating lever 51 is operated by 30% of the total operating amount. (C) designates the state where the operating lever 51 is operated by 60% of the total operating amount. (D) designates the state where the operating lever 51 is operated by the total operating amount. In (A) to (D) in FIG. 8, the solid line indicates a pulse voltage in the excavation mode, and the two-dot chain line indicates a pulse voltage in the finishing mode.

First, as shown in (A) in FIG. 8, when the operating lever 51 is set to a neutral position, the operating angle sensor 65 detects "0". When this detection signal is input in the power-supply control potion 66*a* of the control means 66, the transistor 63*b* is turned off because a signal from the chopper circuit 67 is not output to the base of the transistor 63*b*. Thereby, power from the battery 2 is not supplied to the loop circuit 63 as shown in (A) in FIG. 8. Accordingly, the electric motor 3 is not driven so that the power of the battery 2 is not consumed.

Next, as shown in FIG. 8 (B), in the case where the operating lever 51 is operated by 30% of the total operating amount and the excavation mode is set to the operating mode setting unit 651, the pulse width d1 of the voltage pulse is in the state where 30% is set to the period D of the pulse voltage (d1/D=0.3), as shown by the solid line in (B) of FIG. 8.

That is, a control signal such that the duty ratio by the arithmetic operation by the power-supply control portion 66*a* on the basis of the detected result of the operating angle sensor 65 is 0.3 is output to the chopper circuit 67. The transistor 63*b* is turned on and off so that the duty ratio is 0.3 by the pulse signal from the chopper circuit 67. A pulse voltage as shown in (B) of FIG. 8 is applied to the electric motor 3. An average value with time of current flowing through the loop circuit 63 is 30% of the electromotive force of the battery 2. The electric motor 3 rotates at a rotational speed corresponding to the voltage value.

On the other hand, in the case where in the state of (B) in FIG. 8, the finishing mo de is set to the operating mode setting unit 651, a pulse width d1 of a pulse voltage indicated by the two-dot chain line is 18% (30%*30/50) of the period D of the pulse voltage, and the duty ratio (e1/D) is 0.18.

Next, as shown in (C) of FIG. 8, when the operating amount of the operating lever 51 is set to 60% with respect to the total operating amount, in the case of the excavation mode, a pulse width d2 of the voltage pulse is in the state set to 60% (d2/D=0.6) with respect to the period D of the pulse voltage. In the case of the finishing mode, the pulse width of the voltage pulse is 60% (e2/D=0.36) of the pulse voltage. Thereby, an average value with time of current flowing through the loop circuit 63 is 60% or 36% of the electromotive force of the battery 2 according to the setting mode. The electric motor rotates at a rotational speed faster than that of the case where the previous duty ratio is 0.3 to 0.18.

A description will be made of the case where the operating lever 51 is operated by the maximum as shown in FIG. 8 (D). In the excavation mode, a signal is always output from the chopper circuit 67 to the transistor 63*b*. Thereby, all the electromotive force of the battery 2 is applied to the electric motor 3. The electric motor 3 rotates at the maximum rotational speed. On the other hand, in the finishing mode, a signal in which the duty ratio is 0.6 is output from the chopper circuit 67 to the transistor 63*b*. Power corresponding thereto is supplied to the electric motor 3.

In (A) to (D) of FIG. 8, the description of the voltage pulse in the land readjustment mode is omitted. In the state set to the land readjustment mode, the duty ratio is set to 80% of the duty ratio in the excavation mode.

In the control system in the third embodiment, the operating mode according to the kind of operation to the operating mode setting unit 651 is input in advance prior to the operation, whereby even if the operating amount of the operating lever 51 is the same, the operating speed of the operating member 13 is different every operating mode. Therefore, the bucket 13*c* performs the over action due to the excessive operation of the operating lever 51 in the operation in the finishing mode whereby the consumption of the battery 2 is not quickened through that portion. Further, no inconvenience occurs in which the operation is not progressed unless the operating amount of the operating lever 51 is increased in the operation in the excavation mode. This is greatly effective to suppress the power consumption and to enhance the workability.

In the foregoing, a description has been made of an embodiment to which a so-called positive control is applied as the driving system 6 in which the operating amount of the accel-trimmer 65 and the operating lever 51 is detected, and this operating amount is directly input in the control means 66 to positively control the electric energy supplied to the electric motor 3. Next, a description will be made hereinafter, with reference to FIGS. 9 to 11, of a case to which a so-called negative control is applied to the driving system 6 in which the electric energy supplied to the electric motor 3 is controlled on the basis of the flow rate of extra oil discharged from the hydraulic pump 4 to the hydraulic motor 12*b*.

Figure 9:
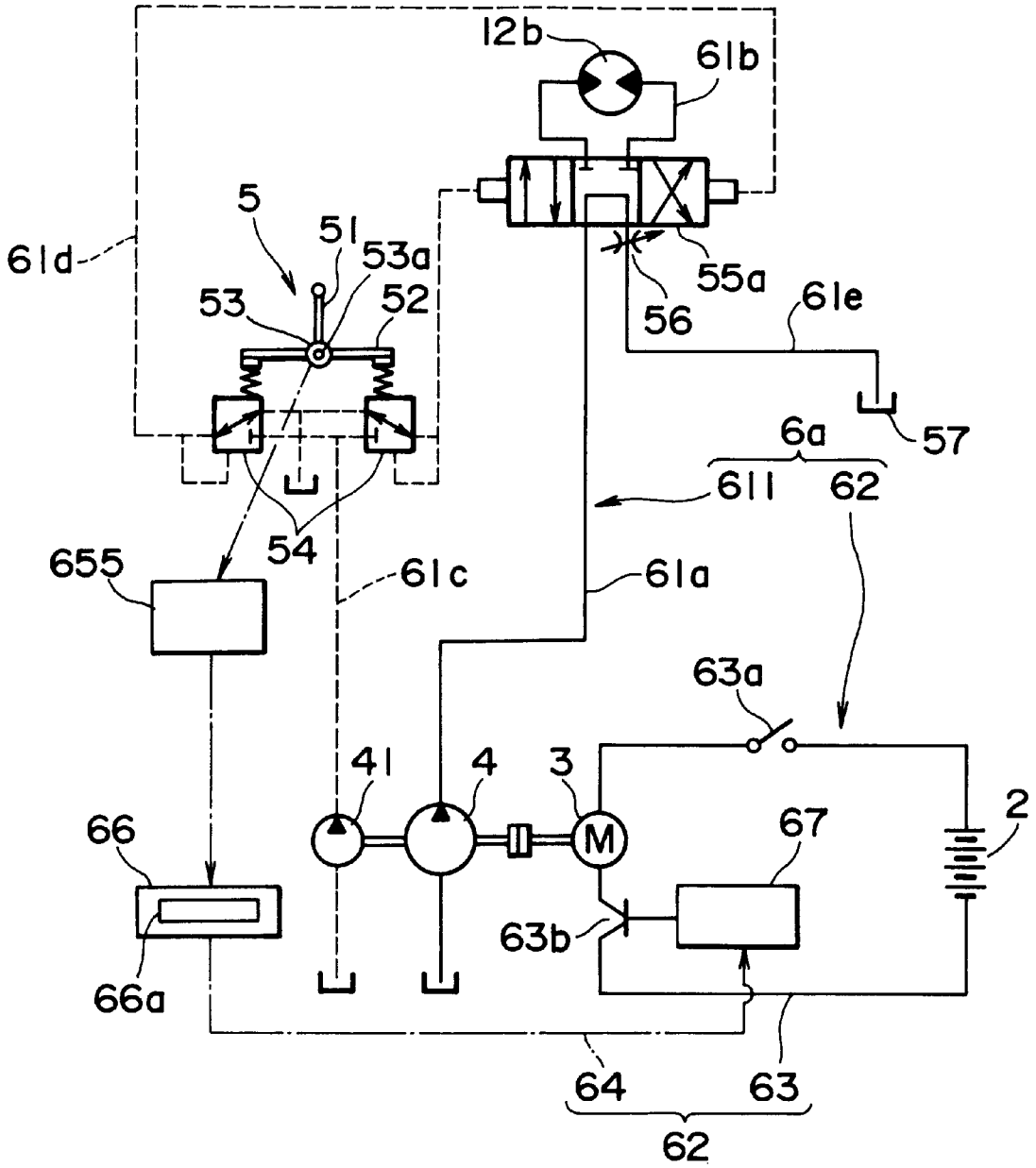
FIG. 9 shows a hydraulic circuit for explaining a control system in a fourth embodiment according to the present invention.

FIG. 9 shows a hydraulic circuit for explaining a control system in a fourth embodiment according to the present invention.

As shown in FIG. 9, in the fourth embodiment, there is employed a so-called tandem type directional control valve

55*a* in which in a state set to an operating oil shut-off position, operating oil is returned to an oil tank 57 passing through a return pipe 61*e* through an opening degree variable flow control valve 56. In the state set to an operating oil flow position, the directional control valve 55*a* is proportional to pressure of pilot oil proportional to an operating amount of the operating lever 51 to change an open area of the valve. The opening degree variable flow control valve 56 changes in opening degree in inverse proportion to the opening degree of the directional control valve 55*a*.

Accordingly, the operating amount of the operating lever 51 set to an operating position is sequentially increased so that the opening degree of the directional control valve 55*a* sequentially increases, and the opening degree of the variable flow control valve 56 sequentially decreases. Therefore, the flow rate to the hydraulic motor 12*b* sequentially increases, and the flow rate returned to the oil tank 57 passing through the opening degree variable flow control valve 56 sequentially decreases. Conversely, the operating amount of the operating lever 51 is decreased so that the opening degree of the directional control valve 55*a* sequentially decreases and the opening degree of the opening degree variable flow control valve 56 sequentially increases. Thereby, the flow rate of the operating oil to the hydraulic motor 12*b* sequentially decreases, and the flow rate to the opening degree variable flow control valve 56 in creases.

In the present embodiment, a neutral position sensor 655 is provided to detect whether or not the operating lever 51 is set to a neutral position. In the case where the operating lever 51 is set to a neutral position, a supply of power from the battery 2 to the electric motor 3 is stopped by the control of the control means 66 on the basis of the detected signal of the neutral position sensor 655. In the case where the operating lever 51 is set to an operating position, power is supplied to the electric motor 3 by the control of the control means 66 on the basis of the fact that the detected signal is not output from the neutral position sensor 655.

According to a driving system 6*a* in the fourth embodiment, a negative control is employed in the hydraulic system 611. Therefore, in the state where the operating lever 51 is set to the operating position, even if the electric energy supplied to the electric motor 3 by the command of the control means 66 is constant, the amount of operating oil supplied to the hydraulic motor 12*b* changes according to the operating amount of the operating lever 51. Thereby, the operating speed of the arm on the extreme end side 13*b* corresponds to the operating amount of the operating lever 51.

When the operating lever 51 at the operating position is returned to a neutral position, the neutral position sensor 655 detects it to input the detected result in the control means 66. Since a supply of power to the electric motor 3 is stopped by the control of the control means 66, the power consumption of the battery 2 is suppressed through that amount. When the operating lever 51 at a neutral position is then returned to the operating position, the position detection by the neutral position sensor 655 is overcome to supply power to the electric motor 3.

Since the detection of the neutral position of the operating lever 51 is not carried out by measuring pressure of operating oil or pilot oil as will be described later, even if the hydraulic pump 4 or the pilot pump 41 is stopped, the fact that the operating lever 51 is operated from the neutral position to the operating position can be discriminated by the control means 66.

Figure 10:
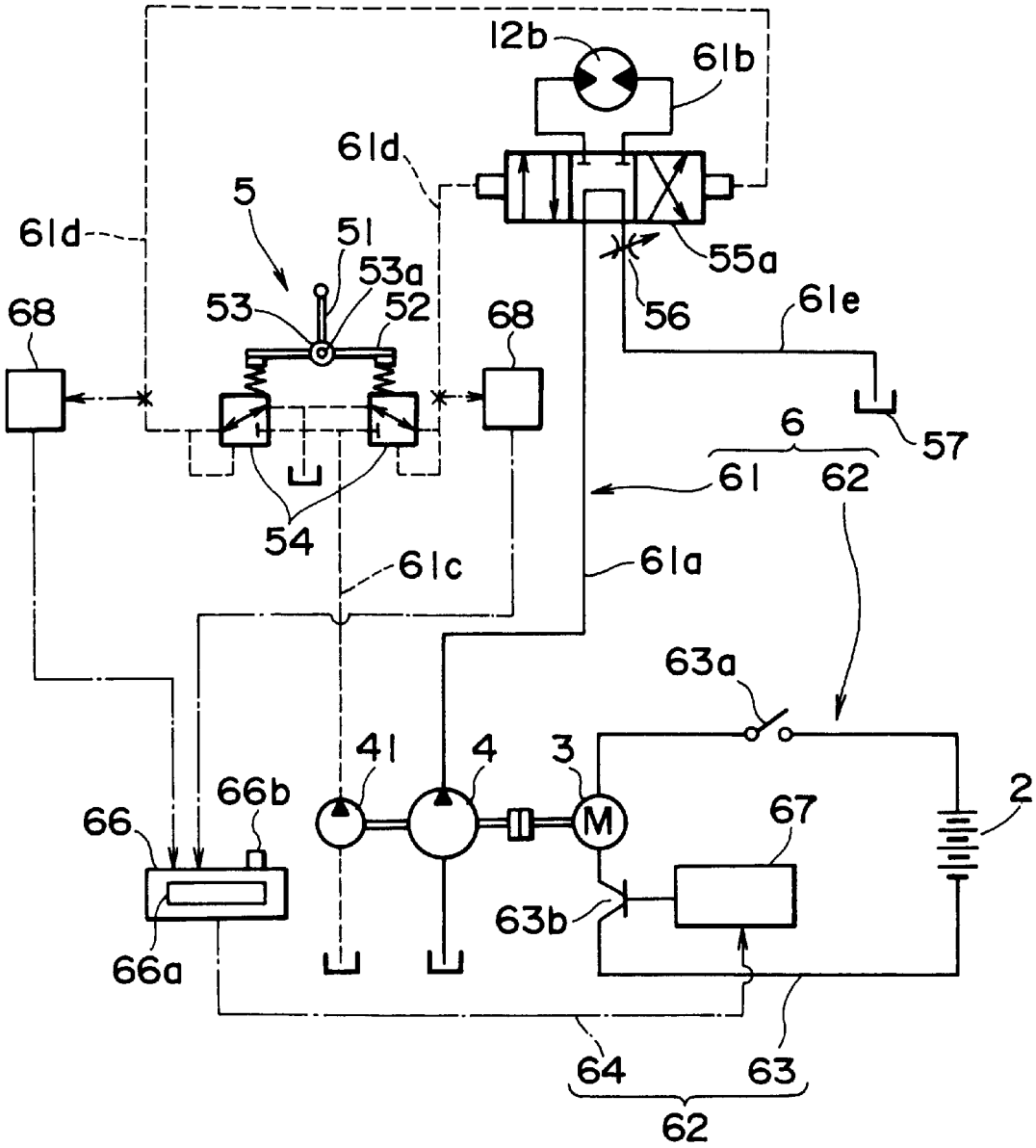
FIG. 10 shows a hydraulic circuit for explaining a control system in a fourth embodiment according to the present invention.

FIG. 10 shows a hydraulic circuit for explaining a control system in a fifth embodiment according to the present invention.

As shown in this figure, in the fifth embodiment, a negative control similar to the fourth embodiment is employed. In place of detection of the operating amount of the operating lever 51, pressure of pilot oil flowing through the second pilot pipe 6 ld is detected to control the electric energy supplied to the electric motor 3 according to the pilot pressure.

The second pilot pipe 6 id is provided with a pilot pressure sensor 68. The detected result of the pilot pressure sensor 68 is input in the control means 66. The control of power supply to the electric motor 3 by the control means 66 is carried out similar to the above on the basis of the input pilot pressure.

Further, the control means 66 is provided with a standby button 66*b*. The standby button 66*b* is operated when the electric motor 3 restarts after the operating lever 51 has been set to a neutral position to stop the supply of power to the electric motor 3. When the button is turned on, the minimum power is supplied to the electric motor 3 through the chopper circuit 67. When the operating lever 51 is set to the operating position by the drive of the pilot pump 41 supplied with the minimum power, oil pressure is generated in the second pilot pipe 61*d*. Thereby, the control by the pilot pressure sensor 68 is carried out.

In this embodiment, since the amount of power supply to the electric motor 3 changes according to the operating amount of the operating lever 51, the operating speed of the arm on the extreme end 13*b* corresponds to the operating amount of the operating lever 51 to facilitate the operation and suppress the consumption amount of power.

Figure 11:
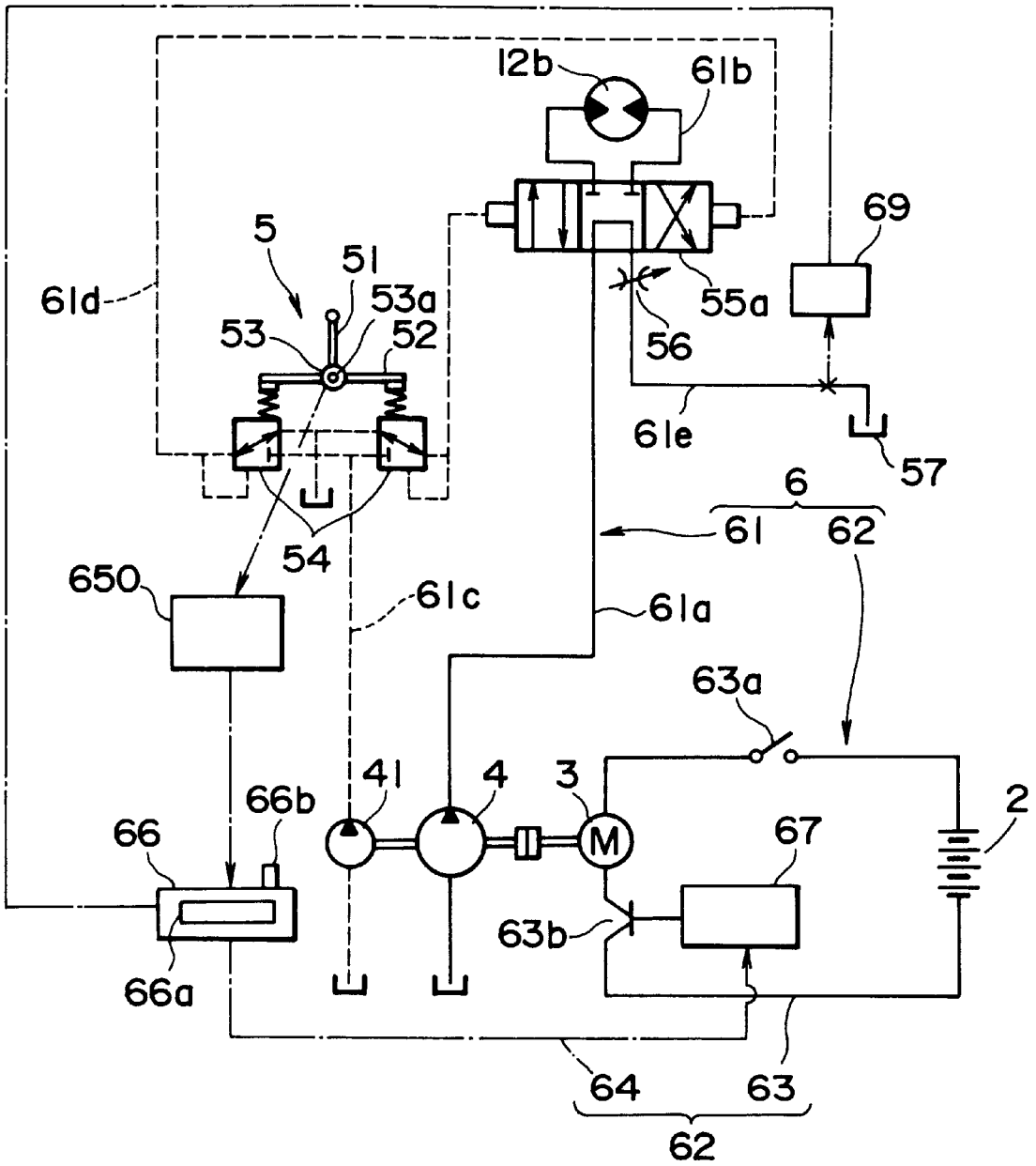
FIG. 11 shows a hydraulic circuit for explaining a control system in a fourth embodiment according to the present invention.

FIG. 11 shows a hydraulic circuit for explaining a control system in a sixth embodiment according to the present invention.

As shown in this figure, in the sixth embodiment, a negative control similar to the fifth embodiment (FIG. 10) is employed. In place of detection of pressure of pilot oil, pressure of operating oil in the return pipe 6 le at downstream of the opening degree variable flow control valve 56 is detected. The electric energy supplied to the electric motor 3 is controlled according to the return pressure.

In the sixth embodiment, a surplus flow rate sensor 69 for detecting the flow rate (surplus flow rate) not used to drive the hydraulic motor 12*b* is provided in the return pipe 61*e* at downstream of the variable flow control valve 56. The detected result of the surplus flow rate sensor 69 is minutely input in the control means 66. Upon receipt of the detected result, the control means 66 outputs a control signal in inverse proportion to the detected result to the chopper circuit 67.

The reason why constituted as described is that the surplus flow rate of operating oil is in inverse proportion to the operating amount of the operating lever 51. The control means 66 is also provided with a standby button 66*b* similar to that of the fifth embodiment (FIG. 10).

Also in this embodiment, since the amount of power supply to the electric motor 3 changes according to the operating amount of the operating lever 51, the operating speed of the arm on the extreme end 13*b* corresponds to the operating amount of the operating lever 51 to facilitate the operation and suppress the consumption amount of power.

The present invention is not limited to the aforementioned embodiments, but includes the following contents.

(1) In the above-described embodiments, the operation of the operating member 13, the rotation of the operator's section 11, and the drive of the crawlers 12 are all carried out by the drive of the actuators 11*a*, 14*a*, 14*b* and 14*c*, and the crawlers 12 caused by the drive of the hydraulic pump 4. Instead, however, the turning force of the electric motor 3 may be directly transmitted to the crawler 12 without intervention of the hydraulic pump 4 to drive the crawler 12. That is, they can be driven without intervention of the hydraulic pump 4.

(2) In the above-described second embodiment, the hold switch type accel-trimmer 65 is used as the setting means. In place of the accel-trimmer 65, an operating lever to be operated by holding a grip or a step type accel-member may be employed.

(3) In the above-described third embodiment (FIG. 6), the duty control according to the operating mode is applied to the bucket 13*c*. The present invention is not limited to an application of the aforesaid control to the bucket 13*c*. The present invention can be applied to either or whole of the arm on the proximal end 13*a*, the arm on the extreme end 13*b*, the direction changing actuator 11*a*, and the hydraulic motor 12*b*.

(4) In the above-described fifth and sixth embodiments FIGS. 10 and 11), the standby button 66*b* is provided on the control means 66, and prior to the operation of the operating lever 51 set to the neutral position thereby and in the state where the electric motor 3 stops, the standby button 66*b* is operated to supply the minimum power to the electric motor 3 to drive it, whereby the operating oil and the pilot oil is risen in pressure by the drive of the hydraulic pump 4 and the pilot pump 41 so that the surplus flow rate sensor 69 and the pilot pressure sensor 68 may detect pressure. In place of the provision of the standby button 66*b*, a sensor for detecting the movement of the operating lever 51 from the neutral position to the operating position is provided (the fourth embodiment FIG. 9)) so that when the sensor detects the movement of the operating lever to the operating position, the minimum power may be first supplied to the electric motor 3. By doing so, in operating the operating lever 51 at the neutral position to the operating position, the cumbersomeness which requires the operation of the standby button 66*b* in advance prior to the former operation is overcome to facilitate the operation of the excavator 1.

We claim:

1. A battery-driven hydraulic excavator comprising:

a lower carriage;

an upper rotating body provided rotatably around a vertical shaft on the lower carriage;

a battery;

an electric motor driven by power from said battery;

a hydraulic pump driven by said electric motor, said hydraulic pump, said electric motor and said battery being mounted interiorly of said upper rotating body;

an actuator driven by operating oil discharged from said hydraulic pump;

an operating member operated by the drive of said actuator; and operating levers for operating said operating members through said actuator by switching a flow and a shut-off of the operating oil discharged from said hydraulic pump, said operating levers and said operating member being mounted on said upper rotating body.

2. The hydraulic excavator according to claim 1, wherein said operating levers are constituted to be operatable between a neutral position at which said operating member stops operation and an operating position at which said operating members operate.

3. The hydraulic excavator according to claim 2, further comprising:

setting means for setting an amount of power supply from said battery to said electric motor, and control means for controlling the amount of power supply to the electric motor according to the operating amount of said setting means.

4. The hydraulic excavator according to claim 1, further comprising:

control means for controlling the amount of power supply to the electric motor.

5. The hydraulic excavator according to claim 3, further comprising an accel-trimmer connected to the control means for setting an amount of power supply from said battery to said electric motor.

6. The hydraulic excavator according to claim 2, further comprising:

an operating amount detection means for detecting an operating amount of the operating lever at the operating position of said operating lever; and a second control means for stopping a power supply from the battery to the electric motor in a state where the operating lever is operated to the neutral position, and for supplying power from the battery to the electric motor according to the operating amount detected by said operating amount detection means in a state where the operating lever is operated to the operating position.

7. The hydraulic excavator according to claim 2, further comprising:

a third control means for stopping a power supply from the battery to the electric motor in a state where all of the operating levers are set to the neutral position, and for supplying power to the electric motor according to the sum of the operating amounts of the operating levers set to the operating position in a state where at least one operating lever is set to the operating position.

8. The hydraulic excavator according to claim 2, further comprising:

an operation mode setting means for changing a supply amount of power to the electric motor according to a kind of operations in a state where said operating levers are set to the operating position.

9. The hydraulic excavator according to claim 2, wherein power is supplied from the battery to the electric motor at a predetermined change rate according to the operating amount of the operating levers.

10. The hydraulic excavator according to claim 8, further comprising:

an operation mode setting means for changing a supply amount of power to the electric motor according to a kind of operations in a state where said operating levers are set to the operating position.

11. The hydraulic excavator according to claim 10, wherein said operating mode setting means is constituted to set said change rate according to the kind of operations input.

12. The hydraulic excavator according to claim 3, wherein said control means comprises a pulse width modulation control means.

13. The hydraulic excavator according to claim 12, wherein said control means does not include a variable resistor.

* * * * *